United States Patent [19]

Felkel

[11] 4,131,757

[45] Dec. 26, 1978

[54] HELICALLY WOUND RETAINING MEMBER FOR A DOUBLE CAGED ARMORED ELECTROMECHANICAL CABLE

[75] Inventor: Edward M. Felkel, Worcester, Mass.

[73] Assignee: United States Steel Corporation, Pittsburgh, Pa.

[21] Appl. No.: 823,250

[22] Filed: Aug. 10, 1977

[51] Int. Cl.[2] ..... H01B 7/18; H01B 9/02

[52] U.S. Cl. ..... 174/107; 174/108; 174/128 R; 138/130; 57/217

[58] Field of Search ..... 174/105 R, 107, 108, 174/109, 128 R, 130, 131 R, 131 A; 138/130, 133; 57/144, 139, 142, 147, 148; 156/51, 52, 56

[56] References Cited

U.S. PATENT DOCUMENTS

| | | | |
|---|---|---|---|
| 475,384 | 5/1892 | Cockburn | 138/130 |
| 1,405,836 | 2/1922 | Green | 57/147 |
| 1,481,801 | 1/1924 | Harrison | 57/147 |
| 2,181,475 | 11/1939 | Bourdon | 174/108 |
| 2,212,700 | 8/1940 | Peterson et al. | 174/108 |
| 3,154,910 | 11/1964 | Deitz | 57/148 |
| 3,542,938 | 11/1970 | Graneau | 174/105 R |
| 3,760,812 | 9/1973 | Timm et al. | 174/130 |

*Primary Examiner*—J. V. Truhe
*Assistant Examiner*—John H. Bouchard
*Attorney, Agent, or Firm*—William A. Danchuk

[57] ABSTRACT

A multiple caged armored electromechanical cable is provided which is characterized in being torque balanced and strength tapered throughout its entire length. The cable is configured having selectively formed elements within the caged armored layers for retaining individual wires in the armored layers statically without appreciable friction between layers.

10 Claims, 8 Drawing Figures

HELICALLY WOUND RETAINING MEMBER FOR A DOUBLE CAGED ARMORED ELECTROMECHANICAL CABLE

BACKGROUND OF THE INVENTION

Currently available electromechanical cables are configured having a strength member external to the electrical conductors which is formed by helically winding a plurality of metal wires about the central electrical core, the helically wound wires covering approximately 95-98% of the outer surface of the electrical core. In order to achieve a torque balance and increase strength, two or more of these armored wire layers are sequentially laid over the electrical core. Attempts have been made to form the helical layers in directions opposite each other so as to achieve torsional balance of the entire cable. Usually this contrahelical construction is limited to two layers only, whereupon the outer layer having the larger moment arm and total armor material cross section generally has the dominating torque and torsional unbalance is caused to exist. A torque unbalance in an electromechanical cable, especially one which is suspended in water, is undesirable because it causes an angular twist in the cable around the cable axis which progresses as tension is applied to the cable by any means when the one cable end is allowed to rotate. A cable having this twisting tendency is subject to damage by various means including kinking and birdcaging which results when the restorative torsional energy of the long length of a cable is released over a relatively short length of the same cable. This local tensional energy release causes a sudden return rotation of the cable which loosens one layer of armor (usually the outer layer) of a contrahelically or double layer armored cable. This loosening causes the armor wires to locally form into a much extended diameter which results in a phenomenon referred to as a birdcage. With regard to kinking, the stored rotational energy within the cable causes several local cable rotations so that cable loops or coils result. Any subsequent tensioning of the cable without prior reverse rotation will result in tightening of the loop with consequent damage to the armor wires and/or the electrical cord.

Another problem relating to currently manufactured electromechanical cables has to do with weight. Specifically, available armored electromechanical cables are fully armored throughout their entire length. As a result, that portion of the cable (usually the top portion of the cable) which supports the remainder of the cable has to support a fully weighted cable throughout its entire length. The strength inherent within the fully armored cable proximate the lower end of the cable (assuming the cable is hung in water) has an inherent strength which is far in excess of that necessary for the support and electrical conductance of relatively light instruments. As a result, the final cable produced is usually of a size and strength which far exceeds, at least at its lower end, the strength necessary for supporting the cable at its lower end.

Another problem associated with currently available electromechanical cables is a limitation of the flexure life of the cable when the assemblage is traversed over a circular surface while the cable is held under tension. Such circular surfaces may include those on sheaves, capstans, winches and the like. Flexure life for currently produced contrahelically armored cables is limited to a value below 50,000 flexure cycles and more generally below 20,000 flexure cycles. Cable flexure life is limited because of the rapid wear of the metallic surfaces of the wires in adjacent armored layers which is caused by the very high compressive forces and poor lubricity. The flexure life will decrease as the ratio of the diameter of bend of the electromechanical cable to the diameter of the largest wire in the strength member assemblage decreases. This ratio in current art is above the value of 400.

SUMMARY OF THE INVENTION

The present invention is addressed to an electromechanical cable construction which provides for the forming of wires in all armored layers in a manner which results in the development of a radial space between all wires and their adjacent counterparts. Once obtained, this spacing is maintained not only by filling the voids with a curable semi-liquid material which is subsequently hardened, but by configuring the wire armored layers such that at least one of the "wires" is formed having a plastic-like outer coating which accepts the wires of the outer layer and which statically retains them in an immobile state. The curable semi-liquid material covering is made to cover the external wires so that no individual wire is exposed to the environment. In a preferred embodiment of the invention, the electromechanical cable construction utilizes two armored layers as described above and is referred to throughout this specification as a double caged armored cable.

The advantages of the double caged armored electromechanical cable of the present invention are numerous. These advantages are multiplied with the introduction of a tapered strength configuration to the double caged armored electromechanical cable. In particular, throughout progressive sublengths of the entire cable's length, individual wires in each of the armored layers are progressively dropped (or added), thereby resulting in a cable having greater strength at one end progressing to the other end at which minimal strength is provided. It should be obvious that a cable of this variety may be supported at its increased strength end and held within a water or air environment in a vertical manner with the decreased strength end supporting the instrumentation connected to the electrically conductive core. The low weight of an electromechanical cable in a fluid such as water is extremely important in order to minimize the cable weight necessary to support itself and the attached load while withstanding drag or other externally imposed forces. The static retention of the cable layers relative to one another permits the tapered strength cable to become a practical reality.

Another advantage of the double caged armored electromechanical cable of the present invention resides in the area of increased flexure life because the mechanism of this failure mode is eliminated. Specifically, the armored wires within the present invention contained within a single armored layer do not abrade on each other because of their separation. Testing in this area has indicated at least a doubling of flexure life. Once again, the plastic-like retention elements permits this spacing and therefore increased cable flexure life.

Probably the most important feature to be gained from the double caged armored electromechanical cable of the present invention has to do with the problem of torque balancing such a cable. Torque balancing can be conveniently handled by proper design of the outer armored layer relative to the inner armored layer.

Due to the spacing of the wires in each of the layers, the space between the wires in the outer armored layer (assuming equal size wires) can be made larger so that the moment in the outer armored layer is made equal to the moment of the inner armored layer. This result is affected by the fact that the moment within any one layer is the product of the pitch radius of the wires in the armored layer times the circumferential forces exerted by the plurality of wires in that layer as tension is applied to the electromechanical cable. The armored technique in this invention permits the strength variance of the cable along its length by stopping some of the individual armored wires at predetermined points along the cable length during the armoring process. By this means, the number of armored wires in any layer at particular cross sections along the cable is varied to conform to the tensile strength requirements for that particular point. Additionally, by varying both the inner and outer wired armored layer simultaneously, tapered strength as well as torque balancing may be effected throughout the entire length of the electromechanical cable according to the present invention. It is important to retain all of the armored layers statically for all strength variance throughout the entire cable.

Accordingly, it is a primary feature and object of the present invention to provide a torque balanced, tapered strength caged armored cable which includes at least one element for statically positioning one layer over another.

It is a general object and feature of the present invention to provide a double caged tapered strength armored cable of a given length with each of the armored layers being formed from a plurality of wires successively and oppositely helically wound about the preceding layer, each of the plurality of wires in each layer being spaced from the adjacent two wires to form a radial space therebetween and having retention elements for retaining each layer immobile with respect to the next.

Yet another object and feature of the present invention is to provide a double caged tapered strength armored electromechanical cable of a given length having first and second armored layers formed from oppositely wound helically shaped first and second pluralities of wires, respectively, each of the first and second pluralities of wires having a given numerical quantity for a given sublength of the whole cable length, the given numerical quantities being changed together progressively for progressive other given sublengths of the whole cable length for producing a tapered strength caged armored electromechanical cable, the cable including elements for preventing substantial movement of one wire in any layer with respect to any other wire in adjacent layer.

Other objects and features of the present invention will, in part, be obvious and will, in part, become apparent as the following description proceeds.

The invention accordingly comprises the apparatus and method possessing the construction, combination of elements, steps, usage levels and arrangements of parts which are exemplified in the following detailed description and the scope of the application which will be indicated in the claims.

BRIEF DESCRIPTION OF THE DRAWINGS

The novel features that are considered characteristic of the invention are set forth with particularity in the annexed claims. The invention itself, however, both as to its structure and its operation, together with additional objects and advantages thereof, will be best understood from the following description of the preferred embodiment of the invention when read in conjunction with the accompanying drawings wherein

DETAILED DESCRIPTION OF THE INVENTION

Figure 1:
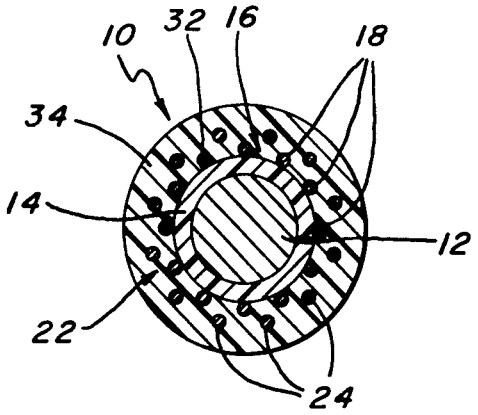
FIG. 1 is a cross-sectional view of one portion of the electromechanical cable according to the present invention taken through a given portion of the cable.
Figure 2:
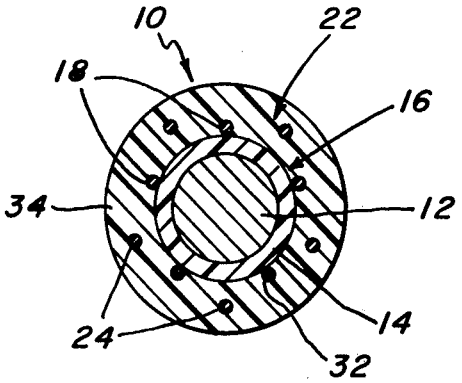
FIG. 2 is a cross-sectional view of the electromechanical cable according to the present invention taken through another portion of the double caged tapered strength armored cable.
Figure 3:
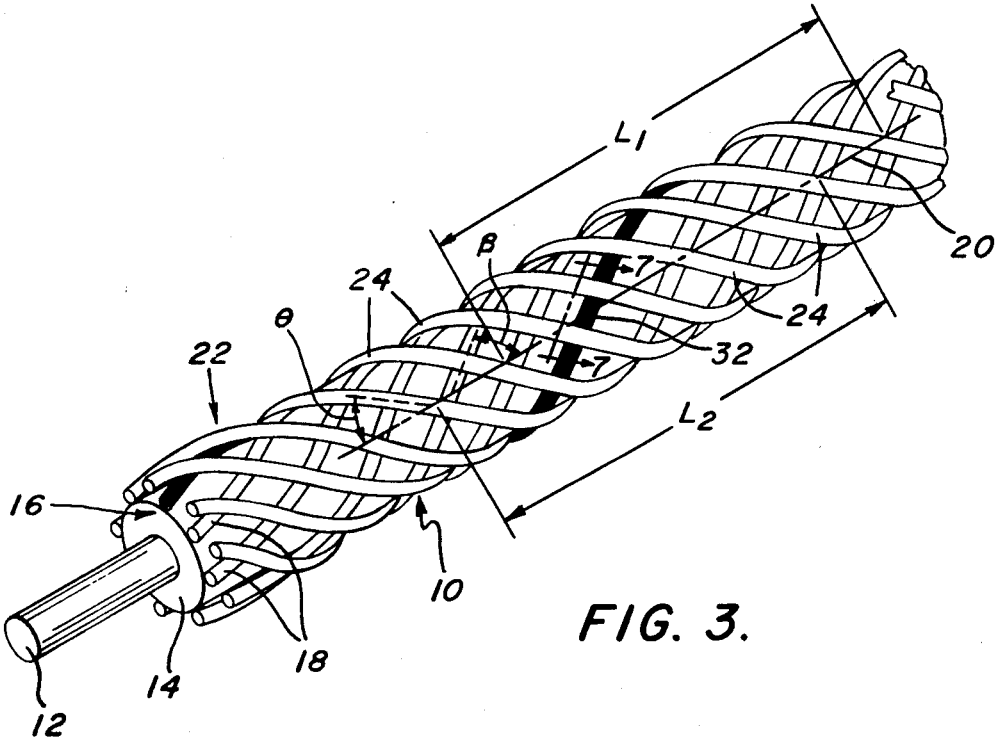
FIG. 3 is a perspective view of the electromechanical cable according to the present invention with portions broken away to reveal internal structure.

Looking to FIGS. 1-3, there is shown both a perspective as well as cross-sectional views of an electromechanical cable generally indicated at 10. The electromechanical cable 10 may be of any length or diameter required for the specific uses to which such a cable would be subjected. Located within the center of the electromechanical cable 10 is a core 12. The core 12 may take on any one of a number of configurations, however, in the preferred embodiment of the present invention, the core 12 is an electrically conductive element running the full length of the cable. The electrically conductive cord 12 may be of a single strand or multiple strand configuration. Once again, in the preferred embodiment of the present invention, the electrical core is made up of a series of small wires wound together throughout the entire length of the electromechanical cable 10. Positioned about the periphery of the electrical core 12 is an insulative coating or member 14 which may take any one of a number of known configurations within the prior art. The insulative member 14 not only insulates the electrical core 12 but partially protects the electrical core from shorting by the armored caged layers located thereabove.

Provided about the circumference of the insulative material 14 is a first armored caged layer 16. The armored caged layer 16 is formed from a plurality of single wires 18. The wires 18 are positioned directly upon the insulative material 14 and are helically wound thereabout as shown in FIG. 3. Each of the wires 18 comprising the first layer 16 are wound at an angle beta with respect to the longitudinal axis 20 of the cable. One other way of gauging the helical winding of the layer is by determining the lay length of one single wire within the layer. The lay length $L_1$ is the distance that a single wire measured from a given point upon the insulative base takes to return to that given position down the cable. The greater the lay length $L_1$ the smaller the angle beta. It should be noted that the plurality of wires 18 within the first caged armored layer are separated from each other and do not abut adjacent wires located within that layer. As previously noted, this is important in order to obviate the binding and abrading of the armored wires on each other as happens in fully armored cables.

Positioned upon the first armored layer 16 is a second armored layer 22. As noted within FIG. 3, the helically wound layer 22, formed from the plurality of wires 24 is wound in an opposite helical winding from the first caged armored layer. This contrahelical winding can best be seen by referring to FIG. 3. The individual wires forming the second armored layer 22 are all orientated at an angle alpha with respect to the longitudinal axis 20 of the cable 10. It should be noted that alpha does not necessarily have to equal the angle beta noted previously with respect to the first armored layer. However, for purposes of simplification and brevity, it is assumed, unless noted otherwise, that the angle alpha is approximately equal to the angle beta. In a manner similar to the first layer, the wires of the second layer 22 may also be referred to (in a helical sense) as having a lay length $L_2$ also defined as the required length of a single wire to return to the same relative position along the longitudinal axis of the cable. Again, for purposes of simplicity and brevity, it is assumed that $L_1$ or the lay length of the wires forming the first armored layer is substantially equal to the lay length $L_2$ of the second or outer caged armored layer. The possible variation of alpha and beta as well as $L_1$ and $L_2$ will be discussed in further detail below.

Figure 6A:
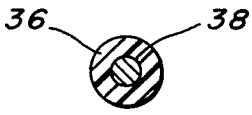
FIG. 6*a* is a cross-sectional view of one embodiment of a wire retention element according to the present invention.
Figure 6B:
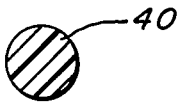
FIG. 6*b* is a cross-sectional view of another embodiment of a wire retention element according to the present invention.
Figure 7:
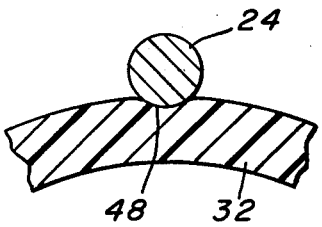
FIG. 7 is a sectional view taken through line 7—7 in FIG. 3.

Located within the inner or first armored caged layer 16 and wound about the insulative member 14 is at least one wire retention element such as that indicated at 32. The wire retention element 32 is helically wound along with the other wires 18 in the first armored layer 16 as may be best seen by referring to FIG. 3. Depending upon the desirability of torque balancing the cable as a whole, the element 32 may be substituted for an individual wire in the layer or added to the entire armored layer as a whole. The wire retention element may take any one of a number of sizes, shapes and configurations. However, in the preferred embodiment of the present invention, the retention element 32 may either be configured as a small wire or even a fabric core 38 having a coating 36, as may be seen in FIG. 6*a*, or as a solid "wire" 40 of the plastic material, as shown in FIG. 6*b*. If the solid "wire" is employed, it is configured having a diameter slightly larger than the diameter of a given wire in the layer so that it more easily "captures" wires of the succeeding layer. Likewise, if a coated wire is employed, the combination is configured having a total resultant diameter equal to or just slightly larger than the other wires. The plastic coating may take any one of a number of forms but preferably is a relatively "soft" and partially deformable plastic or rubber material which, when the second armored layer 22 is contrahelically wound thereupon, will accept, at least partially, in a manner shown in FIG. 7 the wires of the second layer. The general characteristics of the material from which both the coating and the solid "wire" may be formed have been noted. The specific materials which may be employed are as follows:

Low density polyethylene
High density polyethylene
Propylene ethylene copolymer
Polyurethane
Thermoplastic elastomers
Thermoplastic ionomers
Polyvinylchloride Looking to FIG. 7, there can be evidenced the specific manner in which the retention element or elements interreact with the wires of the next succeeding layer. In this regard, it should be noted that cables incorporating multiple armored layers, such as that shown in FIG. 4, would employ at least one wire retention element in each layer with the possible exception of the outermost layer. However, even here, one may desire to employ one element per layer regardless of its relative position. Such a configuration would aid in increasing the "interlocking" of separate layers together. FIG. 7 is a cross-sectional view taken through a line 7—7 normal to the outer wire 24. It may be appreciated how one wire 24 is impressed into a portion of the element 32 leaving a depression 48. It is this interaction which statically retains one layer (such as outer layer 22) relative to the inner layer (such as layer 16). Of course, this interaction is repeated for each wire 24 in the outer layer and may, if retention elements are employed in each layer, be characteristic of every interaction between a wire and a retention element regardless of which layer either is in.

The important features and advantages of caged armored cable and its retention element of elements have been discussed. It is important to further note the advantages of a tapered strength double caged armored cable and in this regard reference should be made to FIGS. 1, 2 and 4. The tapered strength features of the electromechanical cable 10 are effected by the introduction (at given points along the cable's length) of additional wires in each of the two armored caged wire layers 16 and 22. The added wires are placed within the spaces provided between adjacent wires in each layer and are usually, although not necessarily, simultaneously provided to both the first layer 16 and the second layer 22. The points at which the number of wires in each layer are progressively increased or decreased (depending upon which end of the cable is used as a basis) are dictated by the cable requirements and strength for the particular purpose to which the cable will be employed. Additionally, all sublengths of cable, irrespective of how many wires are contained therein, contain at least one retention element in at least the inner layer. The following graph is indicative of one cable embodiment showing the changes in wire numbers per each layer and the relative strength of such sublengths of the entire cable.

EXHIBIT A

| A Section | B Net Wgt. per 1,000' ea. Section pounds | C Total wires | D Section B/S pounds | E Yield Strength (78% B/S) pounds | F Section Length Feet | G Safety Factor Length Feet | H Total Weight of (G) pounds | I Safety Factor | J Total Length Through Section |
|---|---|---|---|---|---|---|---|---|---|
| #1 | 479.78 | 14 × 14 | 26,677 | 20,808 | 13,000 | 13,000 | 6,237.14 | 3.336 | 13,000 |
| #2 | 507.26 | 15 × 15 | 28,582 | 22,294 | 1,000 | 14,000 | 6,744.40 | 3.305 | 14,000 |
| #3 | 534.74 | 16 × 16 | 30,488 | 23,780 | 1,000 | 15,000 | 7,279.14 | 3.266 | 15,000 |
| #4 | 562.22 | 17 × 17 | 32,393 | 25,266 | 1,000 | 16,000 | 7,841.36 | 3.222 | 16,000 |

EXHIBIT A-continued

| A Section | B Net Wgt. per 1,000' ea. Section pounds | C Total wires | D Section B/S pounds | E Yield Strength (78% B/S) pounds | F Section Length Feet | G Safety Factor Length Feet | H Total Weight of (G) pounds | I Safety Factor | J Total Length Through Section |
|---|---|---|---|---|---|---|---|---|---|
| #5 | 589.70 | 18 × 18 | 34,299 | 26,753 | 1,000 | 17,000 | 8,431.06 | 3.173 | 17,000 |
| #6 | 617.18 | 19 × 19 | 36,204 | 28,239 | 1,000 | 18,000 | 9,048.24 | 3.121 | 18,000 |
| #7 | 644.66 | 20 × 20 | 38,110 | 29,725 | 2,000 | 18,000 | 9.378.00 | 3.169 | 20,000 |
| #8 | 672.14 | 21 × 21 | 40,015 | 31,212 | 3,000 | 18,000 | 9,955.08 | 3.135 | 23,000 |
| #9 | 699.62 | 22 × 22 | 41,921 | 32,698 | 2,500 | 18,000 | 10,504.68 | 3.112 | 25,500 |
| #10 | 727.10 | 23 × 23 | 43,826 | 34,184 | 2,000 | 18,000 | 10,999.32 | 3.108 | 27,500 |
| #11 | 754.58 | 24 × 24 | 45,732 | 35,670 | 1,500 | 18,000 | 11,411.52 | 3.125 | 29,000 |

The progressive addition of wires in each of the layers throughout the entire length of the electromechanical cable 10 provides for a tapered strength of the entire cable due to the increased number of supportive wires in each of the layers. The cable may have one or two progressive increases of wire numbers throughout its length or may have several dozen progressive changes throughout its length. In all cases, however, wires are progressively added (or subtracted) as one progresses along the cable from one end to the other along with the continued inclusion of the wire retention element or elements. This former point is indicated in the graph noted above and may be seen as added wires 26 and 28 in FIG. 4.

Looking to FIGS. 1 and 2, it is apparent that FIG. 1 represents a cross-sectional view of the cable 10 at one of its high strength sublengths. It is also apparent that FIG. 2 represents a cross section of the cable 10 taken at a lower strength or lesser strength sublength of the cable 10. Consequently, it should be obvious that the sublength shown in FIG. 1 will support a greater physical load than the sublength indicated in FIG. 2 without the breaking of the individual wires in each of the layers or the wires forming the electrical core. In no case, however, do the individual wires in any layer contact the adjacent wires in the same layer. This provides for the advantage noted above related to flexure life. Currently available contrahelically armored cables have a flexure life which decreases due to the rapid wear of the metallic surfaces of the wires in any one layer rubbing against the adjacent wires in the same layer. The low flexure life problem is eased due to the elimination of this failure mode. That is, the armored cables in any one layer do not abrade on each other due to the separation of each of the wires from the adjacent wires. It is exactly this separation which is permitted by the wire retention elements of the present invention.

A further advantage to be realized from a cable having the attributes of the ones described above is the availability of designing and manufacturing the cable to be torque balanced throughout its entire length, whether the cable is strength tapered or not.

The current problem in constructing electromechanical cables comprising strength members (armored wire layers) external to the electrical conducting core is to helically wind a plurality of metal wires in a manner which causes a torque balancing to the electrical cable as a whole. Inasmuch as priorly contrahelically wound electromechanical cables included strength members having a surface coverage of 95–98% of the electrical core, there resulted an unbalancing of torques due to a greater moment arm at the outer layer than the inner layer. Under a cable configuration having two armored layers, the outer layer has a larger moment arm and total armor material cross section than the inner layer. Consequently, the outer layer has a dominating torque and an unbalancing is caused to exist.

To offset the effect of the larger moment arm in the outer armored layer, the size of the wires in the outer armored layer were made smaller than the wire size of the inner armored layer. This design approach was used to obtain torsional balance with the sacrifice of armor wire abrasion resistance, corrosion life, snag resistance and position stability when the entire assemblage of electrical conductors and armored layers are subjected to flexure. An unbalancing of torques in the electromechanical cable is undesirable because it causes an angular twisting in the cable around the cable axis which progresses as tension is applied to the cable by any means when one end is allowed to rotate. It should be noted in this regard that it is assumed for practical purposes that the electromechanical cable to be torque balanced is hung in a vertical manner with the greater strength sublengths at the top where the cable is supported as a whole and the lesser strength sublengths of the cable below. A cable having the twisting tendency noted above is subject to damage by various mechanisms including kinking and birdcaging which result when the restorative torsional energy of a long length of cable is released over a relatively short length of the same cable. This local torsional energy release causes a sudden return rotation of the cable which tends to loosen one layer of the armor (usually the outer armor of a contrahelically or double layered armored cable) thereby causing a loosening to the outer armored layer. Any subsequent tensioning of the cable may very well cause substantial damage to the outer armored layer and would certainly cause indirect damage insofar as abrasion and wearing of wires would be concerned.

The current problem of torque balancing which is prevalent within the electromechanical cable art may be conveniently handled by proper design of the outer armor relative to the inner armor. As eluded to previously, there are three basic variables in an armored layer which will effect the torsional balancing of a cable. These are the angle at which the helical winding is made to a longitudinal axis such as 20 or the cable (or the lay length discussed previously), the diameter of the individual wires within the layer and the number of wires within a given layer. Due to the spacing of the individual wires within a given armored layer, the wires in any given layer may be increased or decreased in size and in number so that the moment of the outer armor is equal to the moment of the inner armor. For purposes of the present cable, it is assumed that the angular lay of both the inner and outer layered wires are equal. Consequently, the torsional vector of the inner caged armored layer may be exactly counteracted by designing the outer armored layer with wires of different size or number to counteract the larger moment arm of the outer layer compared to the inner layer. When this has been established for a given length or sublength of the entire cable, it is relatively easy to progressively change both the inner and outer layers for tapered strength purposes while retaining a torsional balance to each of the sublengths of the cable throughout such progressive strength tapered changes. Accordingly, there is finally realized a double caged or multiple caged armored cable which also includes a torsional balancing of the cable such that minimal rotation of the cable is realized when vertically hung.

Figure 4:
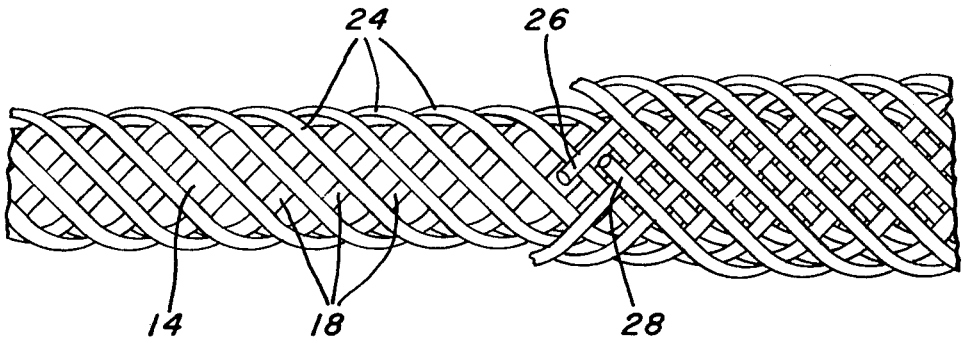
FIG. 4 is a side view of the electromechanical cable of the present invention showing the strength tapering features of the present cable.
Figure 5:
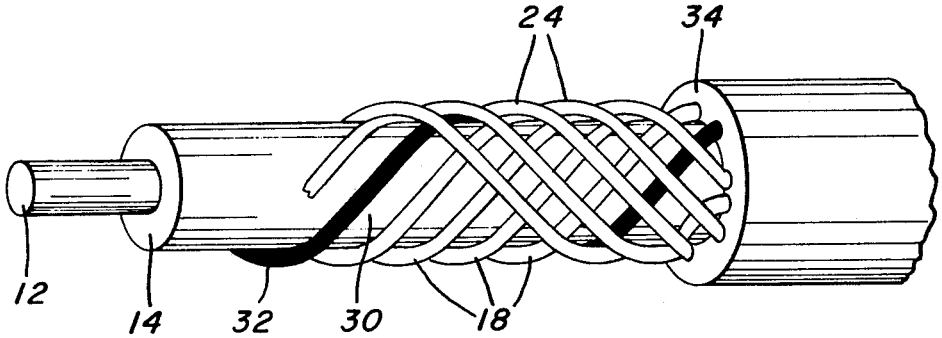
FIG. 5 is a progressive schematic view indicating the steps to be performed in the method for making the cable according to the present invention.

Looking to FIG. 5, there is shown in schematic form the individual steps to be performed in the manufacture of a tapered strength torque balanced electromechanical cable. As noted previously, the electrical core 12 is coated with a conventional insulative material 14. Next, a helical winding of wires having a spacing 30 therebetween is made upon the insulative material 14. As noted previously, one of the wires helically wound is a wire retention element and may take the place of a wire in the inner layer or, alternatively, may be added to the wire layer as a whole. Next, a second winding contrahelically wound to the first layer is made. If a progressive length of the electromechanical cable includes an extra wire which is added at a given point along its length, usual circumstances would dictate that another wire should be added to the outer cable. This is best seen in FIG. 4 as added wire 26 and 28. Finally, as the double layering has been completed, a thermoplastic material 34 is applied or extruded over the double armored caged layers and into the interstitial spaces formed therebetween. This thermoplastic material may take the form of thermoplastic rubber, high density polyethylenes, polyvinylchloride, polypropylene. Additionally, the extrudable thermoplastic material may take the form of thermoplastic elastomeric materials. The thermoplastic material serves a double purpose of protecting the entire double caged armored cable and filling the interstitial spaces located therein so as to aid in the prevention of relative movement of one wire in any given layer relative to another wire. In this general regard, a specific device for safely retaining the ends of progressively added wires to each of the individual armored layers is described in detail in another co-pending application for a United States patent by Edward M. Felkel, entitled SLIP SLEEVE MECHANISM FOR A STRENGTH TAPERED CAGED ARMORED ELECTROMECHANICAL CABLE, Ser. No. 823,252, filed simultaneously herewith and assigned to the assignee of the present invention. The general makeup of a torque balanced strength tapered electromechanical cable is described and claimed in a copending application for a United States patent entitled DOUBLE Caged ARMORED ELECTROMECHANICAL CABLE, Ser. No. 823,251, by Edward M. Felkel, and filed simultaneously and assigned in common herewith.

The retention elements of the present invention permits the manufacture of a tapered strength torque balanced multiple armored cable which is lighter and which has an efficiency of length/strength in order to minimize the cable weight necessary to support itself and its attached load while withstanding drag or other externally imposed forces. The cable is operative to improve the weight in water characteristic due to its tapered strength configuration. It is obviously advantageous to provide a strength capability which varies along the cable length as does the imposed tension loads in order to minimize the cable weight. The armoring and wire retention techniques of the present invention permits the varying of strength of the cable along its length by adding individual wires at predetermined points along the cable length during the armoring process and immobilizing such wires relative to one another. By this means, the number of armored wires at particular cross sections along the cable is varied to conform to the tensile strength requirements at that particular cross section. Additionally, the provision of the present electromechanical cable with regard to torque balancing does away with cable rotation under loaded and unloaded conditions. It should also be noted that throughout the present specification reference has been made, for purposes of simplicity, to a double caged tapered strength armored cable. The characteristics of such a cable may be easily extrapolated, as noted above, to a multi-layered cable having three or more contrahelically wound caged layers.

While certain changes may be made in the above-noted apparatus, without departing from the scope of the invention herein involved, it is intended that all matter contained in the above description, or shown in the accompanying drawings, shall be interpreted as illustrative and not in a limiting sense.

I claim:

1. A multiple caged armored cable of a given length, said cable comprising:

a core;

means covering said core for protecting the same;

a plurality of armored layers of wires located about said covering means, each armored layer being formed from a plurality of wires successively helically wound directly about the preceding layer, the first layer being wound directly over said core;

means for insulatively jacketing the multiple caged armored cable for protecting the cable; and means, formed as a portion of at least one of said inner layers, for retaining each of the individual wires in the next successive layers wound thereupon, said retaining means being generally similar to the wires making up the layer in which said retaining means is located, said retaining means being helically wound along with the wires in the layer in which it is located and being formed having a generally impressionable outer surface which is configured to partially accept wires in the next successive layer for statically retaining the same.

2. A double caged armored electromechanical cable of a given length, said cable comprising:

means for conducting electricity;

means covering said electrical conducting means for electrically insulating the same;

a first armored layer of wires located about said insulating means, said first armored layer being formed from a first plurality of wires helically wound about said insulating means, each of said first plurality of wires being spaced from the adjacent two wires to form a radial space between all of said wires;

a second armored caged layer of wires wound directly upon said first armored layer, said second armored caged layer being formed from a second plurality of wires helically wound about said first plurality of wires, each of said second plurality of wires being spaced from each other a sufficient distance to form radial spaces between all of said second plurality of wires;

means, formed as a portion of said first armored layer, for retaining each of the individual wires in said second armored caged layer in their respective spaced relationship to one another, said retaining means being generally similar to the wires making up said first armored layer, said retaining means being helically wound along with the wires in said first armored layer and being formed having at least a generally plastic outer surface which is configured to partially accept wires in said second armored layer for statically retaining the same with respect to each other and with said retaining means; and means for insulatively jacketing the double caged armored cable for protecting the cable.

3. A double caged armored electromechanical cable of a given length, said cable comprising:

means for conducting electricity;

means covering said electrical conducting means for electrically insulating the same;

a first armored layer of wires located about said insulating means, said first armored layer being formed from a first plurality of wires helically wound in a given direction about said insulating means, each of said first plurality of wires being spaced from the adjacent two wires to form a radial space between all of said wires;

a second armored caged layer of wires wound directly upon said first armored layer, said second armored layer being formed from a second plurality of wires helically wound about said first plurality of wires in the opposite helical winding direction, each of said second plurality of wires being spaced from each other a sufficient distance to form radial spaces between all of said second plurality of wires;

means, formed as a portion of said first armored caged layer, for retaining each of the individual wires in said second armored layer in their respective spaced relationship to one another, said retaining means being generally similar to the wires making up said first armored layer, said retaining means being helically wound along with the wires in said first armored layer and being formed having at least a generally plastic outer surface which is configured to partially accept wires in said second armored layer for statically retaining the same with respect to each other and with said retaining means; and means for insulatively jacketing the double caged armored cable for protecting the cable.

4. The double caged electromechanical cable according to claim 3 wherein said cable includes retaining means formed as a portion of both said first and said second armored layers of wires, said retaining means interlocking with one another for increased wire stability in both layers.

5. The double caged electromechanical cable according to claim 3 wherein said cable includes a plurality of said retaining means formed as a portion of said first armored layer of wires.

6. The double caged electromechanical cable according to claim 3 in which said retaining means is configured having a wire core, smaller in diameter than the remaining wires in said first armored layer, and an outer resilient coating for accepting and retaining wires of said second armored layer, the combined diameter of said inner core and outer resilient coating being substantially equal to the individual wires in said first layer.

7. The double caged electromechanical cable according to claim 3 in which said retaining means is configured as a solid resilient material element having a diameter substantially equal to the individual wires in said first layers.

8. The double caged electromechanical cable according to claim 3 in which at least an outer portion of said retaining means is formed from an electrically insulative material.

9. The double caged electromechanical cable according to claim 8 in which said retaining means includes an outer covering of thermoplastic material.

10. The double caged electromechanical cable according to claim 8 in which said outer covering is polyolefin.

* * * * *